US005564496A

United States Patent [19]

Blum et al.

[11] Patent Number: 5,564,496

[45] Date of Patent: Oct. 15, 1996

[54] COMPOSITE PARTING SHEET

[75] Inventors: Bernard S. Blum, Longmeadow, Mass.; Mark Zaffetti, Windsor Locks, Conn.

[73] Assignee: United Technologies Corporation, Hartford, Conn.

[21] Appl. No.: 332,979

[22] Filed: Nov. 1, 1994

[51] Int. Cl.[6] ..... F28F 19/00

[52] U.S. Cl. ..... 165/134.1; 165/133; 165/166; 428/933; 428/653

[58] Field of Search ..... 428/650–654, 428/933; 165/133, 134.1, 166

[56] References Cited

U.S. PATENT DOCUMENTS

| | | | |
|---|---|---|---|
| 3,018,543 | 1/1962 | Beck | 29/157.3 |
| 3,482,305 | 12/1969 | Dockus et al. | 29/487 |
| 3,627,503 | 12/1971 | Brill-Edwards | 29/197 |
| 3,642,457 | 2/1972 | Brill-Edwards | 29/196.5 |
| 3,771,214 | 11/1973 | Binger et al. | 29/488 |
| 3,970,337 | 7/1976 | Dockus | 228/208 |
| 4,246,045 | 1/1981 | Ulam | 428/653 X |
| 4,702,969 | 10/1987 | Bunkoczy et al. | 428/635 |
| 4,729,929 | 3/1988 | Shinoda et al. | 428/653 |
| 5,110,690 | 5/1992 | Usui et al. | 428/678 |
| 5,125,452 | 6/1992 | Yamauchi et al. | 165/133 |
| 5,292,595 | 3/1994 | Yamauchi et al. | 428/654 |

*Primary Examiner*—Allen J. Flanigan
*Attorney, Agent, or Firm*—Malcolm J. Chisolm, Jr.

[57] ABSTRACT

A composite parting sheet is disclosed for separating hot and cold layers in a heat exchanger core. Known parting sheets being primarily aluminum are subject to leakage due to corrosion and failure resulting from thermal fatigue stress. The composite sheet of the present invention includes a first aluminum outer layer, a second aluminum outer layer and a central metallic layer between and in contact with the first and second aluminum outer layers so that the central metallic layer comprises a continuous, uninterrupted layer between the first and second outer layers, and the central metallic layer is a metal that is more noble than aluminum, such as nickel. Corrosion penetrating either of the outer layers to produce a pin hole preferentially corrodes aluminum over the central metallic layer. Therefore, the corrosion expands sideways upon contact with the central metallic layer, and the pin hole does not penetrate the layer or the parting sheet, thereby inhibiting corrosion induced leakage. The central metallic layer has a lower thermal expansion coefficient than a comparable aluminum layer. Therefore, expansion of the composite parting sheet in response to temperature fluctuations is reduced, resulting in reduced thermal fatigue stress.

11 Claims, 2 Drawing Sheets

COMPOSITE PARTING SHEET

TECHNICAL FIELD

The present invention relates to parting sheets between hot and cold layers in heat exchangers, and especially relates to a composite parting sheet for minimizing corrosion and thermal fatigue stress of parting sheets in plate and fin heat exchangers.

BACKGROUND OF THE INVENTION

As is well known in the art, heat exchangers, such as plate and fin heat exchangers, typically include separate hot and cold circuits that respectively direct a working fluid and a heat-exchange fluid through adjacent hot and cold layers. The hot and cold layers are often stacked on top of each other to form a core of the heat exchanger. Each layer may have one or more heat-transfer fins positioned within the layer in a ruffled, serrated or serpentine manner to maximize the surface area of the fins within the layer. The heat-transfer fins are affixed to parting sheets at opposed surfaces of the layers. The sheets separate the layers from each other and form barriers to prohibit mixing of the fluids in adjacent hot and cold layers.

In operation of a plate and fin heat exchanger that is being used to extract heat from the working fluid, the working fluid passes through a hot circuit that directs the fluid through at least one hot layer, while the heat-exchange fluid is directed by a cold circuit through an adjacent cold layer. Heat from the working fluid moves through the heat-transfer fins of the hot layer; through the parting sheet affixed to those fins; into the heat-transfer fins of the adjacent cold layer; and, into the heat-exchange fluid to be removed from the heat exchanger as the heat-exchange fluid moves through the cold circuit out of the heat exchanger. In many plate and fin heat exchangers, the hot and cold circuits will direct the working and heat-exchange fluids through a plurality of adjacent hot and cold layers; the actual number of layers being a function of the operating and desired temperature of the working fluid, the temperature of the heat-exchange fluid, the flow rates of the respective fluids, and the surface areas of the heat transfer fins and layers.

The working and heat-exchange fluids in such heat exchangers may both be liquid, or they may both be gas, or one may be a gas while the other is a liquid. For example, in a conventional automobile powered by a liquid-cooled internal combustion engine, the radiator for the engine coolant is a standard heat exchanger wherein the working fluid is a liquid (the coolant) and the heat-exchange fluid is a gas, namely—the atmosphere. In a modern aircraft powered by a gas turbine engine, it is common to use air bled from compressor stages of the engine for many aircraft sub-systems, including cabin air conditioning. Plate and fin heat exchangers utilizing a gaseous heat-exchange fluid are frequently used in such aircraft to regulate the temperature of the working fluid which in such an example would be the compressed air bled from the engine.

In most working environments of heat exchangers, as in those described above, a critical design parameter is a desire to reduce the weight of the exchanger as much as possible. Consequently, aluminum is almost invariably used to form the parting sheets and heat-transfer fins because of its light weight. Aluminum, however, presents significant problems in typical heat exchanger applications, especially when used as the parting sheet. Aluminum is very susceptible to corrosion. Penetration of a parting sheet as a result of corrosion may produce a pin hole leak through the sheet such that the working and heat-exchange fluids mix. In that event, the heat exchanger core must be taken out of service and repaired or discarded and replaced. Additionally, aluminum, in comparison to the metals typically used as frames, housings and/or mounting fixtures for heat exchanger cores, has a very high coefficient of expansion. Consequently, aluminum parting sheets are subject to severe thermal fatigue stress as temperatures fluctuate during use, limiting the duration of their useful life. Both susceptibility to corrosion and thermal fatigue stress therefore present substantial reliability and cost problems for known heat exchangers.

Accordingly, it is the general object of the present invention to provide an improved parting sheet that overcomes the reliability and cost problems of the prior art.

It is a more specific object to provide an improved parting sheet for heat exchangers that minimizes corrosion induced puncture of the sheet.

It is yet another object to provide an improved parting sheet for heat exchangers that minimizes thermal fatigue stress of the sheet.

The above and other advantages of this invention will become more readily apparent when the following description is read in conjunction with the accompanying drawings.

DISCLOSURE OF THE INVENTION

An improved parting sheet for heat exchangers is disclosed that minimizes corrosion and thermal fatigue stress of parting sheets between hot and cold layers in a heat exchanger core. A working fluid and a heat-exchange fluid pass respectively through adjacent hot and cold layers so that heat may pass between the fluids. The parting sheets separate the hot and cold layers prohibiting mixing of the fluids.

In a particular embodiment, the invention comprises a composite parting sheet having a first aluminum outer layer, an opposed second aluminum outer layer, and a central metallic layer between and in contact with the first and second aluminum outer layers, wherein the central metallic layer comprises a metal that is more noble than aluminum, and the central metallic layer forms a continuous, uninterrupted metal layer between the first and second aluminum outer layers. The invention includes a method of forming the improved composite parting sheet comprising the steps of positioning first and second aluminum outer layers of braze clad aluminum sheets in contact with opposed surfaces of a central metallic layer comprising a metal that is more noble than aluminum, and heating the layers to a temperature below the melting temperature of the metal comprising the central metallic layer but to a sufficiently high temperature to braze or diffusion bond the first and second outer layers to the central metallic layer. The composite parting sheet can also be produced by conventional rolling, wherein the first and second outer aluminum layers are positioned adjacent opposed surfaces of the central metallic layer to form a sandwich, and the three layers are rolled together in a process similar to that used to make conventional braze clad aluminum sheets; a process well known in the art.

In use of the composite parting sheet, corrosion of either the first or second aluminum outer layers will penetrate the layer, resulting in a pin hole, until the agent causing the corrosion (e.g., water) contacts the central metallic layer. Because the central metallic layer comprises a metal that is more noble than aluminum (e.g., nickel), the aluminum outer layer will corrode preferentially to the central metallic layer, causing the corrosion to expand sideways further corroding the aluminum layer, rather than allowing the pin hole to penetrate the central metallic layer. Therefore, the composite parting sheet inhibits leakage through the central metallic layer resulting from corrosion. Additionally, the central metallic layer comprises a metal that has a lower thermal expansion coefficient than the thermal expansion coefficient of aluminum. Therefore, the central metallic layer inhibits total expansion of the composite parting sheet so that it will expand less than a comparable sheet of aluminum in response to temperature increases, thereby minimizing thermal fatigue stress to the composite parting sheet.

BEST MODE FOR CARRYING OUT THE INVENTION

Figure 1:
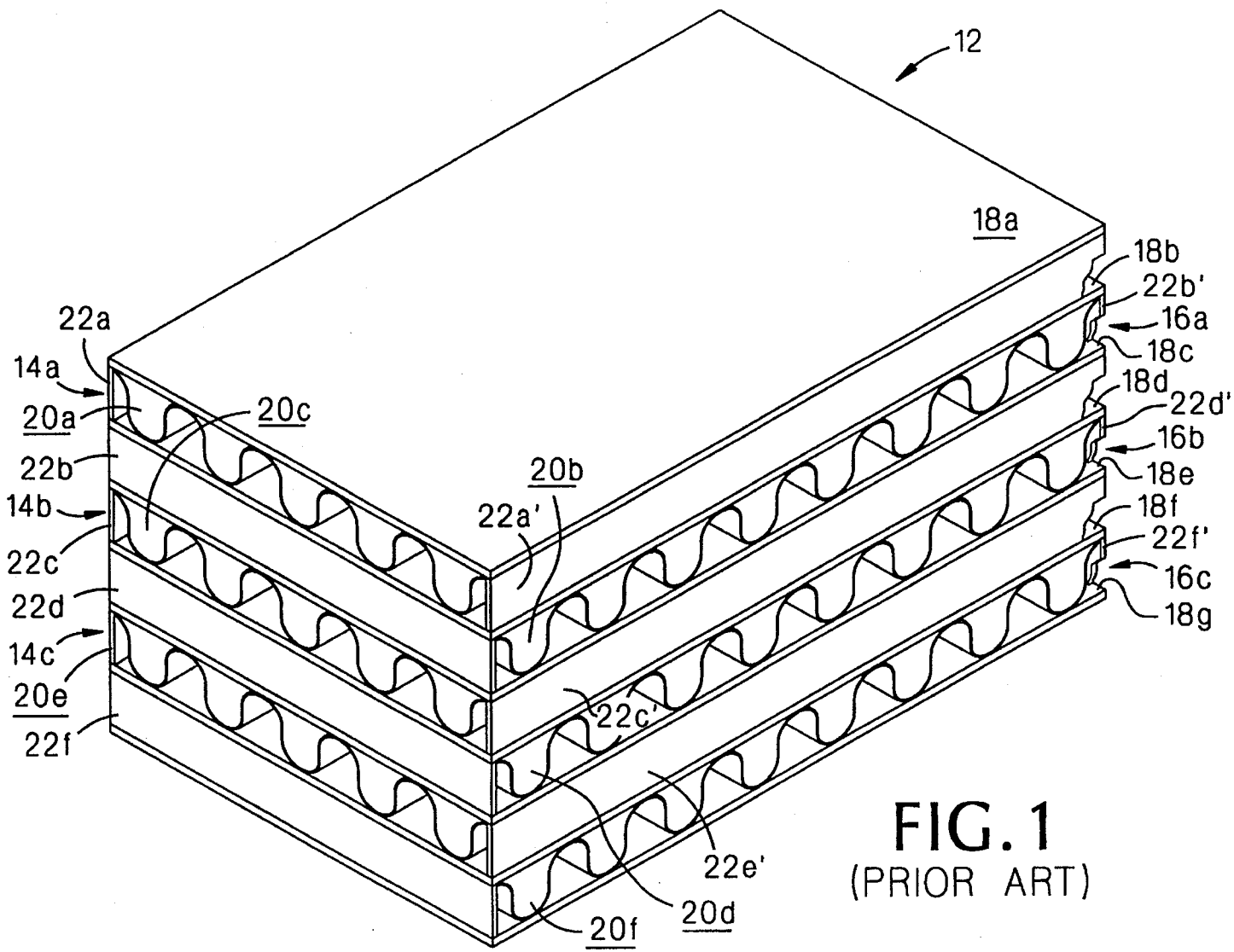
FIG. 1 (PRIOR ART)
FIG. 1 is a perspective view of a prior art heat exchanger core showing parting sheets separating hot and cold layers.
Figure 2:
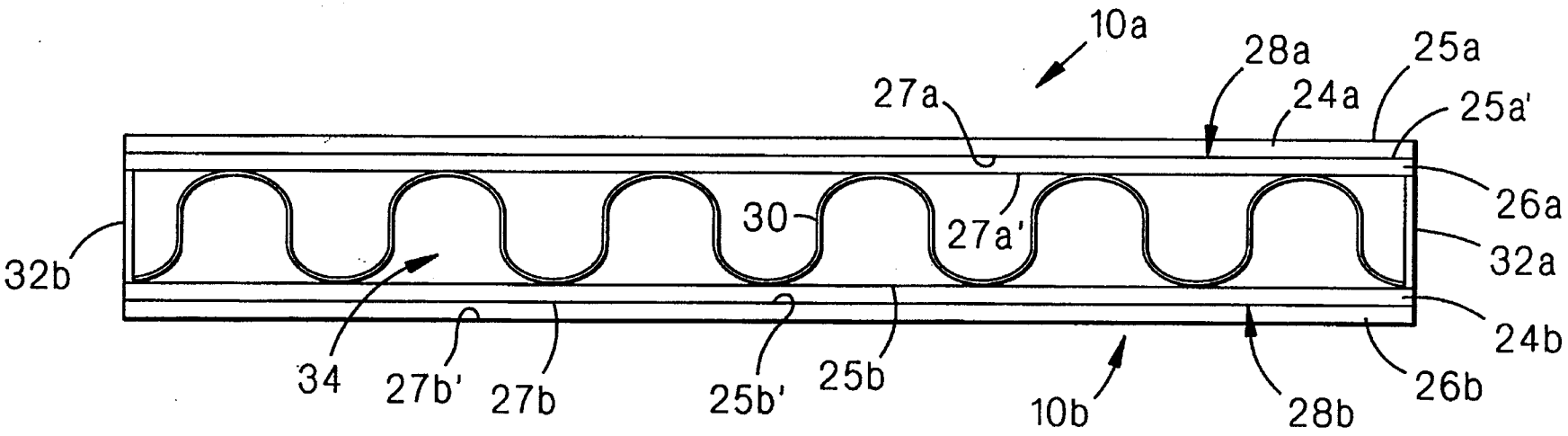
FIG. 2 is a cross-section view of a layer of a heat exchanger core having composite parting sheets constructed in accordance with the present invention.

Referring to the drawings in detail, composite parting sheets of the present invention are best seen in FIG. 2, and generally designated by the reference numerals 10*a* and 10*b*. As best seen in FIG. 1, a prior art heat exchanger core 12 is an appropriate working environment for the composite parting sheets 10*a*, 10*b*. The core 12 includes a plurality of hot layers 14*a*, 14*b*, 14*c*, and a plurality of cold layers 16*a*, 16*b*, 16*c* positioned adjacent and between the hot layers, and a plurality of parting sheets 18*a*, 18*b*, 18*c*, 18*d*, 18*e*, 18*f*, 18*g* between the hot (14*a*–14*c*) and cold (16*a*–16*c*) layers. Each of the hot and cold layers includes a heat-transfer fin 20*a*, 20*b*, 20*c*, 20*d*, 20*e*, 20*f* positioned within the layers, and a pair of opposed closure bars 22*a*, 22*a'*, 22*b*, 22*b'*, 22*c*, 22*c'*, 22*d*, 22*d'*, 22*e*, 22*e'*, 22*f*, 22*f'* positioned at opposed sides of the layers. In use of the core 12 to extract heat from a working fluid (not shown), the working fluid is directed through the hot layers 14*a*–14*c* while a heat-exchange fluid (not shown) having a lower temperature than the working fluid is directed through the cold layers 16*a*–16*c* in such a manner that the fluids do not mix. Heat in the working fluid moves through the heat-transfer fins 20*a*–20*f* and parting sheets 18*a*–18*g* to be removed from the core as the heat-exchange fluid moves through and out of the core 12.

As best seen in FIG. 2, the composite parting sheets 10*a*, 10*b* of the present invention include a first aluminum outer layer 24*a*, 24*b* having opposed first layer contact surfaces 25*a*, 25*a'*, 25*b*, 25*b'*; a second aluminum outer layer 26*a*, 26*b* having opposed second layer contact surfaces 27*a*, 27*a'*, 27*a*, 27*a'*; and a central metallic layer 28*a*, 28*b* having opposed central layer contact surfaces (not shown). The central metallic layer 28*a*, 28*b* is positioned between and in contact with the first and second aluminum outer layers to form the composite parting sheets 10*a*, 10*b*, in the shape of a sandwich, wherein a first layer contact surface (e.g., 25*a'*) of a first aluminum outer layer 24*a*, and a second layer contact surface (e.g., 27*a*) of a second aluminum outer layer 26*a* contact and overlie the opposed central layer contact surfaces of the central metallic layer 28*a*to form composite sheet 10*a*, as shown in FIG. 2. The composite parting sheets 10*a*, 10*b* enclose a standard heat-transfer fin 30 between two opposed standard closure bars 32*a* and 32*b* to form a standard layer 34 of a heat exchanger core (not shown), as shown in FIG. 2.

The first and second aluminum outer layers 24*a*, 24*b* and 26*a*, 26*b* may preferably be fabricated of approximately 0.014 inch thick braze clad aluminum, such as product number CT-23, manufactured by the Aluminum Company of America, of Pittsburgh, Pa. The central metallic layer is formed of a metal that is more noble that aluminum, such as corrosion resistant steel, nickel, titanium, copper, iron, columbium or alloys or mixtures thereof, such as ICONEL® (manufactured by the International Nickel Company, of New York, N.Y.), HASTELOY® (manufactured by the Stellite, Corp., of Kokima, Ind.). In a preferred embodiment the central metallic layer is a standard 0.002 inch nickel foil, such as product no. AMS 5553 manufactured by many entities including the International Nickel Company, of New York, N.Y. The central metallic layer 28*a*, 28*b* forms a continuous, uninterrupted metallic layer between the first and second aluminum outer layers 24*a*, 24*b* and 26*a*, 26*b*.

A composite parting sheet 10*a* or 10*b* is fabricated by securing a central metallic layer 28*a*or 28*b* between first and second aluminum outer layers 24*a* and 26*a*, or 24*b* and 26*b*, so that opposed surfaces of the central metallic layer contact adjacent surfaces of the first and second aluminum outer layers, and next brazing the first and second aluminum outer layers to the central metallic layer by raising the temperature of the three layers enough to melt a standard braze cladding (not shown) on the first and second aluminum outer layers. The first and second aluminum outer layers may be joined to the central metallic layer also by other known bonding techniques such as diffusion bonding, roll bonding, or metallurgically joining the three layers together. In all methods of joining the layers, however, the temperature is not raised beyond the melting temperature of the metal comprising the central metallic layer so that the central metallic layer 28*a*or 28*b* maintains a continuous metallic layer between the first and second aluminum outer layers. For convenience, the raising of the temperature to melt the braze cladding can be done at the same time as other components (e.g., the closure bars 32*a*, 32*b*) are secured to the heat exchanger core 12 through a brazing and/or a bonding process.

The composite parting sheet of the present invention 10*a* or 10*b* has demonstrated enhanced resistance to corrosion and thermal fatigue stress when the central metallic layer 28*a*or 28*b* is as thin as a 0.0001 inch thick layer of nickel. Such a layer has been positioned in contact with either the first or second aluminum outer layer by known vacuum deposit methods for extremely thin layers, prior to brazing of the three layers.

In use of the composite parting sheet 10*a* or 10*b* of the present invention, any corrosion of either the first or second aluminum outer layers 24*a*, 24*b* or 26*a*, 26*b*, will penetrate the layer, resulting in a pin hole (not shown), until the agent causing the corrosion (e.g., water) contacts the central metallic layer 28*a* or 28*b*. Because the central metallic layer comprises a metal that is more noble than aluminum, the aluminum layer will corrode preferentially to the central layer, causing the corrosion to expand sideways further corroding the aluminum outer layers, rather than allowing the pin hole to penetrate the central metallic layer. Therefore, the composite parting sheet 10*a*, 10*b* inhibits leakage through the central metallic layer 28*a*, 28*b* resulting from corrosion. Additionally, the central metallic layer comprises a metal that has a lower thermal expansion coefficient than the thermal expansion coefficient of aluminum. Therefore, the central metallic layer 28*a*, 28*b* inhibits total expansion of the composite parting sheet 10*a*, 10*b* so that it will expand less than a comparable sheet (not shown) of aluminum in response to temperature increases, thereby minimizing thermal fatigue stress to the composite parting sheet.

While the present invention has been described with respect to a particular construction of a heat exchanger core 12, it will be understood by those skilled in the art that the present invention is not limited to this particular example. Accordingly, reference should be made primarily to the attached claims rather than the foregoing specification to determine the scope of the invention.

What is claimed is:

1. A composite parting sheet for separating hot and cold layers in a heat exchanger core, which comprises:

a. a first aluminum outer layer about 0.014 inches thick having opposed first layer contact surfaces;

b. a second aluminum outer layer about 0.014 inches thick having opposed second layer contact surfaces; and c. a central metallic layer having opposed central layer contact surfaces, the central metallic layer being positioned between and in contact with the first and second aluminum outer layers wherein a first layer contact surface and a second layer contact surface contact and overlie the opposed central layer contact surfaces so that the central metallic layer forms a continuous, uninterrupted layer between the first and second aluminum outer layers, and the central metallic layer comprises a nickel foil about 0.002 inches thick.

2. In a heat exchanger core having a working fluid and a heat-exchange fluid passing respectively through adjacent hot and cold layers so that heat passes between the fluids and having parting sheets between the adjacent hot and cold layers prohibiting mixing of the fluids, the improvement comprising a composite parting sheet between the adjacent hot and cold layers, the composite parting sheet including a first aluminum outer layer, a second aluminum outer layer and a central metallic layer positioned between and in contact with the first and second aluminum outer layers in the form of a sandwich so that the central metallic layer forms a continuous, uninterrupted layer between the first and second aluminum outer layers, and the central metallic layer is a non-aluminum metal that is more noble than aluminum and is thinner than the outer layers.

3. The composite parting sheet of claim 2, wherein the central metallic layer is corrosion resistant steel, nickel, titanium, copper, iron, columbium or mixtures thereof.

4. The composite parting sheet of claim 2, wherein the first and second aluminum outer layers comprise braze clad aluminum sheets between about 0.006 inches to about 0.030 inches thick.

5. The composite parting sheet of claim 4, wherein the central metallic layer further comprises a layer between about 0.0005 inches to about 0.020 thick.

6. The composite parting sheet of claim 5, wherein the first and second aluminum outer layers are about 0.014 inches thick and the central metallic layer further comprises a nickel foil about 0.002 inches thick.

7. The composite parting sheet of claim 6, wherein the central metallic layer has a thermal expansion coefficient lower than the thermal expansion coefficient of aluminum.

8. In a heat exchanger core having a working fluid and a heat-exchange fluid passing respectively through adjacent hot and cold layers so that heat passes between the fluids and having parting sheets between the adjacent hot and cold layers prohibiting mixing of the fluids, the improvement comprising a composite parting sheet between the adjacent hot and cold layers, the composite parting sheet including a first aluminum outer layer, a second aluminum outer layer and a central metallic layer positioned between and in contact with the first and second aluminum outer layers in the form of a sandwich so that the central metallic layer forms a continuous, uninterrupted layer between the first and second aluminum outer layers, the first and second aluminum outer layers comprise braze clad aluminum sheets about 0.006 inches to about 0.030 inches thick, and the central metallic layer is a metal that is more noble than aluminum.

9. The composite parting sheet of claim 8, wherein the central metallic layer further comprises a layer between about 0.0005 inches to about 0.020 thick.

10. The composite parting sheet of claim 9, wherein the first and second aluminum outer layers are about 0.014 inches thick and the central metallic layer further comprises a nickel foil about 0.002 inches thick.

11. The composite parting sheet of claim 10, wherein the central metallic layer has a thermal expansion coefficient lower than the thermal expansion coefficient of aluminum.

* * * * *